United States Patent [19]

Freimark et al.

[11] 4,041,498

[45] Aug. 9, 1977

[54] COLLAPSIBLE ADJUSTABLE LENGTH CITIZENS-BAND ANTENNA WITH COIL CONCEALING STRUCTURE

[75] Inventors: Ronald J. Freimark; Laszlo N. Repay, both of Chagrin Falls, Ohio

[73] Assignee: Tenna Corporation, Cleveland, Ohio

[21] Appl. No.: 690,578

[22] Filed: May 27, 1976

[51] Int. Cl.[2] ..... H01Q 9/18

[52] U.S. Cl. ..... 343/749; 343/903

[58] Field of Search ..... 343/715, 749, 900, 903, 343/889

[56] References Cited

U.S. PATENT DOCUMENTS 3,380,062 4/1968 George ..... 343/903

*Primary Examiner*—Alfred E. Smith
*Assistant Examiner*—David K. Moore
*Attorney, Agent, or Firm*—Watts, Hoffman, Fisher & Heinke Co.

[57] ABSTRACT

A collapsible antenna, adjustable in length and carrying an impedance-matching coil, especially suitable for use with citizens-band transceivers that are operated from automobiles. When the antenna is collapsed, the coil is concealed within an antenna support, which in automotive applications is typically located beneath a vehicle body panel.

2 Claims, 5 Drawing Figures

COLLAPSIBLE ADJUSTABLE LENGTH CITIZENS-BAND ANTENNA WITH COIL CONCEALING STRUCTURE

BACKGROUND OF THE INVENTION

1. Field of the Invention

This invention relates to a radio antenna and particularly an adjustable length, collapsible antenna with a loading coil.

2. Prior Art

Antennas, such as ¼ wave vertical antennas, with impedance-matching or so-called "loading" coils used with combination radio receiver and transmitter equipment and have become common in automotive use with the popularity of citizens-band transceivers. Typical antennas are in the form of a whip (solid rod) or tubular sections, and have either a base coil or a coil incorporated midway along the length of the antenna. Fine tuning of antennas has been accomplished by adjusting the length through clipping an end to shorten the length, or by adjusting an end portion that is telescoped relative to a carrying portion.

Since the presence of antennas of this type on vehicles often invites theft of the related radio equipment, it has become common to mount the antennas with clamps or the like to facilitate removal of the antenna by the owner, when the vehicle is not in use.

Heretofore, insofar as applicants are aware, no satisfactory antenna with a loading coil, suitable for use with citizens-band transceivers, has been available that is retractable or collapsible into concealment for automotive use. Collapsible antennas with coils are known, as are coil-receiving antennas that can be adjusted in length to modify performance; but known arrangements have failed to provide a citizens-band antenna that is both collapsible and adjustable in length, and in which a coil intermediate the ends of the antenna is concealed within support structure when the antenna is collapsed. Known arrangements of antennas with loading coils also have not been motor driven between extended and retracted positions.

SUMMARY OF THE INVENTION

The present invention provides an antenna for a citizens-band transceiver or other radio requiring an antenna with a loading inductance coil, which is collapsible, adjustable in length to obtain optimum performance, and in which the coil is concealed when the antenna is collapsed. In a preferred construction, the antenna is motor driven in extension and retraction.

The above features are obtained through the use of a telescoping multisection antenna in which a tubular loading coil is supported at one end of an intermediate tubular section. An antenna segment of similar diameter to the supporting section is secured to the unsupported end of the coil for longitudinal adjustment. An adjacent smaller diameter antenna section telescopes within the adjustable segment, the coil, and the coil-supporting section. The carrying section in turn telescopes within a surrounding antenna section. A conventional driving cord is attached to the inner and end section of the antenna for extending and retracting the antenna, and passes through the adjustable segment, the coil, and the telescoping sections of the antenna.

When the antenna is collapsed, the antenna sections, except for a small portion thereof, and the loading coil are received in a tubular support. Depending upon how and where the antenna is mounted, the small extending portion may be exposed, e.g., by projecting above a body panel of a vehicle, or the tubular support may be located so that both it and the extending portion of the collapsed antenna wll be entirely beneath a body panel of an automotive vehicle and hence totally concealed. In one preferred embodiment, a stop at the top of the coil serves to limit retraction of the antenna by abutting the upper end of the tubular support, and advantageously seals the passage into which the antenna sections have been retracted. Alternatively, the coil or associated structure can be closely received within and partially extend from a receiving passage of a tubular surrounding member, and act as a plug in peripherally sealing and sliding relationship with the surrounding member.

Providing adjustment of the overall antenna length with a segment associated with the antenna coil and carried by an intermediate section directly adjacent the end and inner section of the antenna has several advantages. With a construction as described, the adjustment of the extended length of the antenna will be maintained during extension and retraction; the antenna sections can be extended and retracted through a conventional cord drive secured to the end section and traveling within the other telescoped sections and coil; the length adjustment is provided in an antenna portion beyond the loading coil, i.e., between the coil and the remote end of the antenna, which is important for good performance; and only one antenna section need travel through the coil, so the coil can be of minimum diameter and the size of the opening in the support required to receive the antenna coil can be minimized.

Adjustment of the antenna length is conveniently achieved by securing the longitudinally adjustable segment to the antenna coil with a surrounding collet carried at one end of the coil form. When the antenna is collapsed, only portions of the adjustable section, the collet and a coil cover extend from the tubular support.

In one embodiment, a stop at the top of the tuning coil is a flange integral with a cover sleeve for the coil, closely surrounding the collet that holds the adjustable segment at the top of the coil, and projecting radially to limit retraction of the antenna by engaging the top of the antenna support when the antenna is collapsed. Preferably, the stop is a circular flange that forms a seal around the receiving aperture in the antenna support to inhibit entry of water, dirt and the like. In another embodiment, a controlled diameter of the cover sleeve or collet form a seal with the receiving aperture.

Other features and advantages of this invention will become more apparent from the detailed description that follows, when considered in connection with the accompanying drawings.

DETAILED DESCRIPTION

Figure 1:
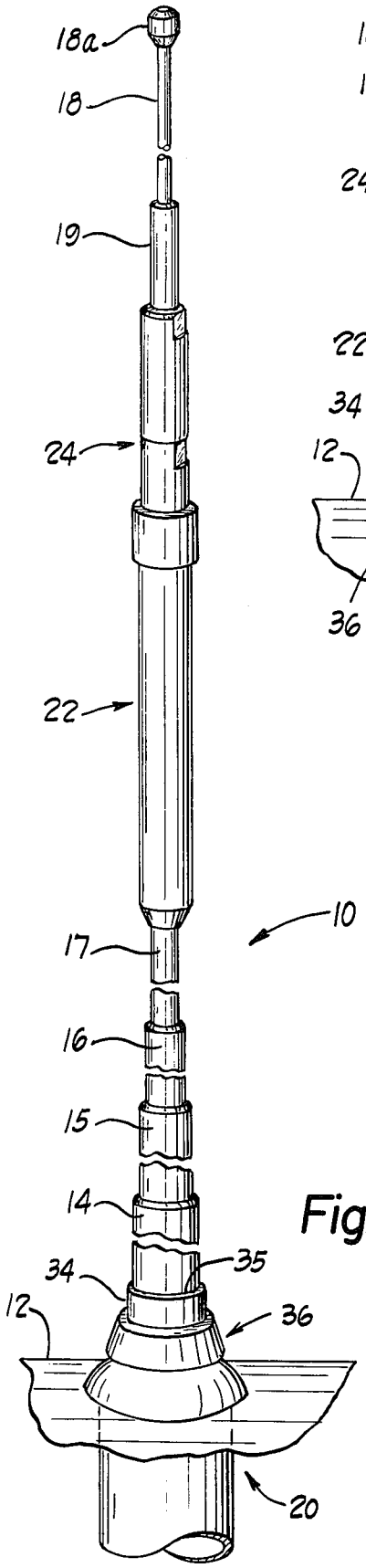
FIG. 1 is a perspective view of an extended, telescopic, citizens-band automotive antenna embodying the present invention.
Figure 2:
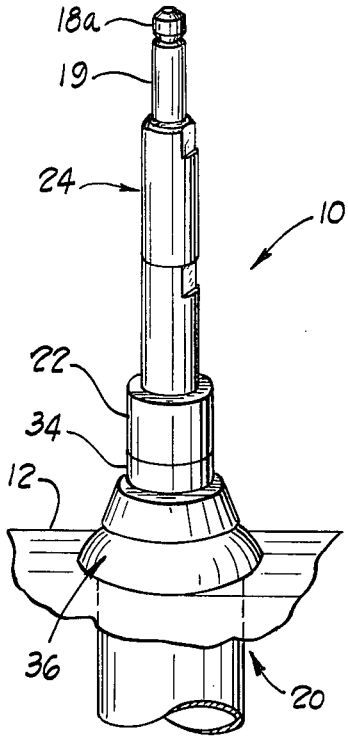
FIG. 2 is a perspective view of the antenna of FIG. 1 in a collapsed or retracted condition.

FIGS. 1 and 2 illustrate an antenna assembly 10 embodying the present invention, supported for illustration purposes beneath a body panel 12 of a motor vehicle. Telescopic sections 14, 15, 16, 17 and 18 of the antenna extend from a support 20. A loading inductance coil assembly 22 and length adjustment assembly 24 are carried intermediate the ends of the antenna, specifically by the antenna section 17. FIG. 2 shows the antenna sections 14–18 retracted and illustrates the manner in which the coil assembly 22 is concealed within the support 20.

In its extended condition, the antenna assembly 10 is of a length suitable for use with citizens-band radios—i.e., it is a ¼ wave antenna utilizing a suitable inductance coil assembly 22 to artificially load the antenna system to resonance with the operating frequencies. Depending upon the specific installation, some adjustment in length of the antenna, typically not more than ¾ inch, may be required for optimum performance. Basically, this adjustment is afforded through a separate antenna segment 19 carried with the coil assembly 22 by the section 17. Segment 19 is adjustable longitudinally relative to the section 17 through the length adjustment assembly 24.

As best shown in FIG. 2, when the antenna sections are retracted, the antenna sections 14–18 and the coil assembly 22, except for an upper flange, are received in the support 20. Only a part of the length adjustment assembly 24, a part of the segment 19, and a button **18*a* at the end of the antenna section 18 are visible above the support 20 and panel 12, extending a distance of about 2 inches on a typical embodiment. By mounting the support 20 in a different manner and at a lower level beneath the panel 12,** the entire structure can be located beneath the panel when the antenna is retracted. A small opening in the panel then provides for the passage of the antenna sections. One factor limiting the choice is the increased height required beneath the panel to permit mounting the structure at a lower position.

Figure 3:
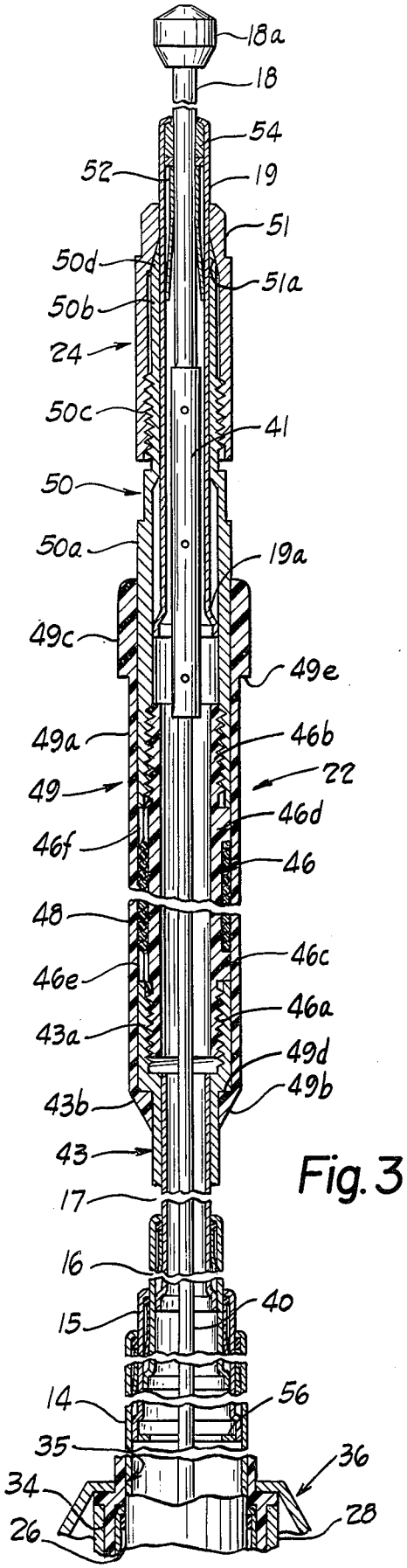
FIG. 3 is a longitudinal section view, with parts in elevation, of the antenna of FIG. 1 illustrating constructional details.
Figure 4:
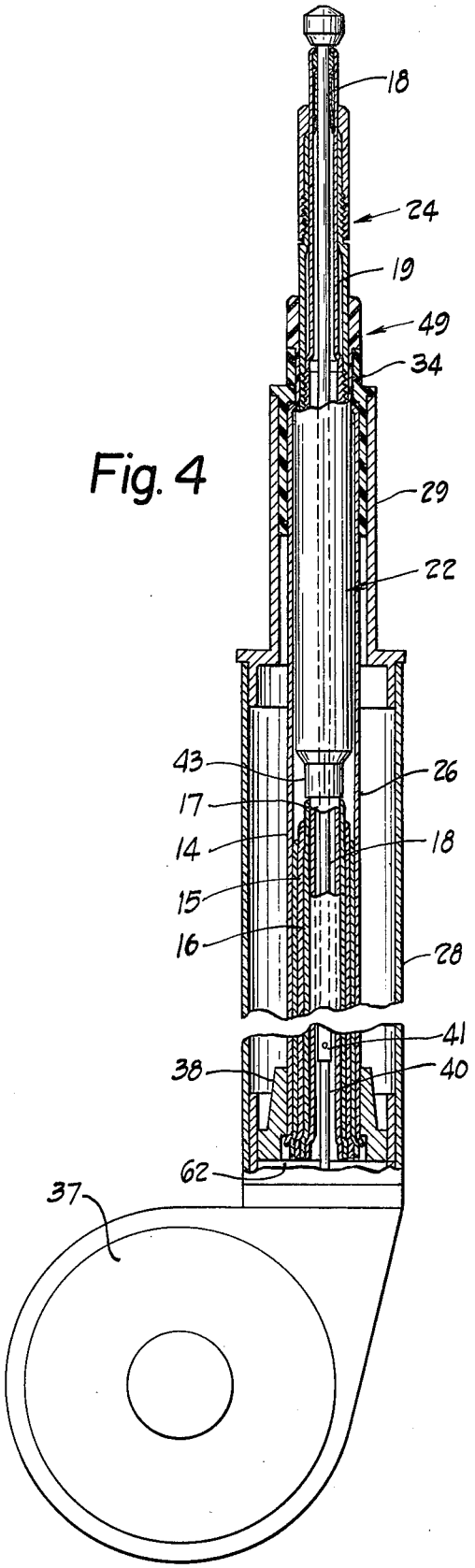
FIG. 4 is a longitudinal sectional view, with parts in elevation, of the antenna assembly of FIG. 1 in a collapsed condition, showing the support structure, motor drive and relationship of the loading coil to the support structure with the antenna collapsed.

The construction of the antenna assembly 10 is shown in more detail in FIGS. 3 and 4. The support 20 is secured by conventional means behind or beneath a body panel 12 in a vehicle application of the antenna, and as shown in FIG. 4, houses not only the extensible antenna sections 14–18, but also a fixed antenna section 26. The support 20 includes a tubular housing 28, an upper housing extension 29, and a tubular end piece 34 supported on the extension 29 that forms an aperture 35 (FIG. 1) for the movable antenna sections. The end piece closely receives and guides the coil assembly 22 when the antenna is collapsed and partially projects above the body panel 12. A conventional decorative external fastening flange and nut assembly 36 surround the end piece above the panel 12 and cover the opening through the body panel. An electrically powered, switch controlled, motor drive and transmission unit 37 is carried at the lower end of the tubular housing 28 for extending and retracting the antenna sections under power.

As shown in FIG. 4, the fixed antenna section 26 is secured at its lower end in a fixed collar 38 within the tubular housing 28 and terminates at its upper end within the projecting end piece 34. In use, the section 26 is electrically connected to an associated transceiver in a conventional manner (not shown).

The coil assembly 22 is cylindrical in shape and of a size that fits closely within the opening 35 of the projecting end piece 34 and also within the fixed antenna section 26. The coil is essentially of the diameter of the largest movable antenna section 14. Extension and retraction of the antenna sections is accomplished through a flexible cord 40 connected to the lower end of the antenna section 18 by a coupling 41 and driven by the motor and transmission 37 in a known manner; for example, as shown in U.S. Pat. No. 2,896,870 for U.S. application Ser. No. 615,410, filed Sept. 22, 1975, and now abandoned.

Each of the antenna sections 14, 15 and 16 are substantially coextensive when collapsed, and as shown in FIG. 4, the upper ends of those sections are substantially beneath the housing extension 29. The section 17 extends beyond sections 14, 15 and 16 in the collapsed condition and carries a sleeve 43 pressed onto its end that supports the coil assembly 22. The coil assembly extends above the section 17 within the housing extension 29. The length adjustment assembly 24 extends upward beyond the end piece 34.

As best shown in FIG. 3, the coil assembly 22 includes a tubular coil form 46, a wire inductance or loading coil 48, and a cover sleeve 49. The sleeve 43 that supports the coil assembly has an enlarged upper end **43*a* that is internally threaded and which forms an external shoulder 43*b*. The internal thread receives one threaded end 46*a* of the tubular coil form 46, which is made of synthetic resin and constructed to carry the loading coil 48. The opposite end 46*b* of the coil form is also threaded and supports a metal collet 50. Collars 46*c*, 46*d* of the coil form define an area in which the loading coil 48 is confined. The coil is formed of insulated wire wound in a single layer of adjacent coil loops. Each opposite end of the coil 48 extends through a slot 46*e*, 46*f* of the adjacent collar and is soldered or clamped to the adjacent sleeve 43 and collet 50,** respectively, to electrically connect the coil with the antenna sections at each end of the coil form.

The collet 50, a collet cap 51 and the antenna segment 19 comprise the length adjustment assembly 24. The collet 50 has a body portion **50*a* of a size to fit closely within the sleeve 49 and which is internally threaded to receive the threaded end 46*b* of the coil form. The inside diameter of the body portion 50*a* is of a diameter sufficient to receive a wider base portion 19*a* of the antenna segment 19. Finger portions 50*b* are formed at the opposite end of the collet 50 from the body portion 50*a* and have an inside diameter smaller than body portion 50*a*, to closely surround the antenna segment 19 beyond its base portion. The collet cap 51 fits over the antenna segment 19 and the finger portions 50*b* of the collet and is threaded onto an intermediate threaded portion 50*c* of the collet. When the collet cap 51 is screwed toward the body portion 50 of the collet it clamps finger portions 50*b* against the antenna segment 19 by virtue of internal inclined portions 51*a* that act against external inclined portions 50*d* of the finger portions. With this arrangement, the longitudinal relationship of antenna segment 19 relative to the collet 50 and coil assembly 22 can be changed to adjust the overall length of the antenna assembly when it is extended. As seen from FIG. 3, the top edges of contact strips 52** carried by the antenna section 18 abut against an internal seal assembly 54 of antenna segment 19 when section 18 is fully extended. Thus the longitudinal position of segment 19 affects the overall length of the extended antenna by changing the length beyond the coil 48.

The outer sleeve 49 of the coil assembly is preferably of synthetic resin and covers the upper part 43*a* of the collar 43, the coil form 46, the coil 48, and part of the collet body 50*a.* The outer sleeve is constructed to protect the coil, guide the coil into the aperture 35 of the tubular end piece 34 during retraction of the antenna, and to limit travel of the antenna into the support during retraction. For these purposes the sleeve has a central portion 49*a,* a tapered end portion 49*b,* and an upper collar portion 49*c.* An inner shoulder 49*d* between the portions 49*a* and 49*b* abuts against the shoulder 43*b* of the collar 43 to prevent upward movement of the outer sleeve relative to the coil form. A radial shoulder 49*e* between the collar 49*c* and the central portion 49*a* abuts the upper terminus of the end piece 34 to limit inward movement of the antenna section 17 relative to the support 20. In addition, the collar 49*c* and shoulder 49*e* close and seal the aperture 35 of the tubular end piece 34 and thereby prevent the entrance of water, dirt and the like into the antenna support when the antenna is retracted. In retracted condition, the outer sleeve 49 of the coil assembly is received and closely encircled by the tubular end piece 34 and the fixed antenna section 26. Only part of the collet 50, assembly 24, a portion of antenna segment 19, the button 18*a,* and the collar 49*c* project beyond the support 20.

Figure 5:
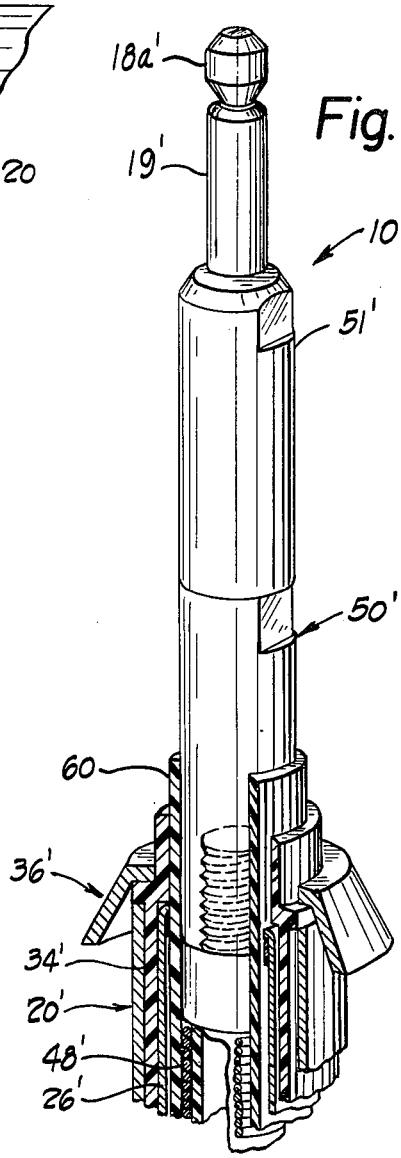
FIG. 5 is a perspective, partially cutaway view on a larger scale, of another embodiment of the invention having a different coil sleeve construction for effecting a seal with the tubular antenna support.

A slightly modified embodiment 10' is shown in FIG. 5, where parts corresponding to those in the embodiment of FIGS. 1–4 are indicated by the same reference number with a prime designation. In this construction, the coil assembly has a cover sleeve 60 of uniform thickness or outside diameter (except for a beveled lower portion as in the sleeve 49). The sleeve slides within the tubular end piece 34' with a close enough fit to provide a seal sufficient to prevent entry of water, dirt and the like into the support assembly. Alternatively, it is contemplated that the sleeve 60 can be of smaller diameter and terminate at the bottom of the collet 50', with the collet and sleeve having the same outside diameter. The antenna section 14 would then be elongated to receive the coil and sleeve and extend through and terminate just above the end piece 34 in its collapsed position. Section 14 would be essentially in the position of the sleeve 60 of FIG. 5, to form a seal with the surrounded collet body 50 and with the surrounding end piece 34.

In operation, considering the embodiment of FIGS. 1–4, the antenna sections 14–18 are extended from a collapsed condition within the support 20 by operating the motor and transmission 37 to drive the flexible cord and extend the section 18. When the tops of contact strips 52 of section 18 abut the seal 54 of the top of the segment 19, the section 18 draws the segment 19, the coil assembly 22, and the section 17 from the support. In a similar manner, section 17 then draws sections 16, 15 and 14 from the support until the antenna is fully extended. Retraction is accomplished by withdrawing the flexible cord 40 from the bottom of the extended antenna, causing the button 18*a* to contact the end of antenna segment 19, which then moves section 17 inward. The collar 43 abuts the top of section 16 to move it inward. The bottom of section 16 abuts a stop 56 at the bottom of the next surrounding section 15 and telescopes that section into the next, abutting a similar stop at the bottom of section 14, moving the sections inward until the shoulder 49*e* contacts the end piece 34, stopping further retraction. In the embodiment of FIG. 5, retraction would be stopped by the antenna section 14 bottoming against a base piece 62 (FIG. 4). An overriding clutch within the drive motor and transmission 37 or an automatic shutoff switch prevents stalling of the drive motor at the end of antenna travel. To adjust the extended length of the antenna, the collet cap 51 or 51' is loosened, the segment 19 or 19' is slid manually further into or out of the collet body to the desired position, and the cap tightened.

From the above description it will be seen that an antenna having a loading coil intermediate its ends has been provided that is collapsible, adjustable in length beyond the coil, and in which the coil is concealed when the antenna is collapsed. While a preferred embodiment of the invention has been disclosed in detail, it will be understood that mofidications or alterations may be made therein without departing from the spirit and scope of the invention claimed.

What is claimed is:

1. An adjustable length, collapsible, motor driven antenna suitable for use with so-called citizens-band transceivers, comprising:

inner, outer, and intermediate longitudinally movable telescoping antenna sections, at least all but the inner section being tubular;

a support for said sections into which the sections are at least partially receivable when the antenna is collapsed, said support being elongated and having an opening at one end through which the sections pass when moved into and out of said support;

an electrically powered drive including motor and transmission secured to said support and a flexible cord extensible through at least all but the inner antenna section and driven by said motor and transmission, to extend and retract the antenna sections;

a loading coil carried by and electrically coupled with an intermediate section next adjacent to the inner section, said coil being around a tubular coil form secured at one end to said carrying section and having a collet secured to the other end, the coil being electrically coupled with the carrying section and the collet;

a tubular antenna segment shorter than said sections, coaxial with and of the same diameter as said carrying section, slidably secured within said collet and forming an extension of the carrying section and which when moved axially in the collet changes the length of the antenna beyond the coil; and a cover sleeve over the tuning coil and coil form, said sleeve having a central portion of a diameter no greater than that of the outer movable telescoping section and receivable in said opening and support, and a portion at the opposite end of the sleeve tapered inwardly in a direction away from said central portion.

2. An antenna as set forth in claim 1 wherein said sleeve includes a radial flange at the end adjacent the collet for abutting the support when the antenna is retracted.

* * * * *